US008663073B1

(12) United States Patent
Hays

(10) Patent No.: US 8,663,073 B1
(45) Date of Patent: Mar. 4, 2014

(54) PORTABLE PUNCHING BAG APPARATUS

(76) Inventor: Nicholas A. Hays, Sarasota, FL (US)

( * ) Notice: Subject to any disclaimer, the term of this patent is extended or adjusted under 35 U.S.C. 154(b) by 223 days.

(21) Appl. No.: 13/344,800

(22) Filed: Jan. 6, 2012

(51) Int. Cl.
*A63B 21/00* (2006.01)

(52) U.S. Cl.
USPC ..... 482/83; 482/90; 482/87

(58) Field of Classification Search
USPC ..... 482/904, 83, 87, 90, 907
See application file for complete search history.

(56) References Cited

U.S. PATENT DOCUMENTS 4,787,626 A * 11/1988 Gallagher ..... 482/140
5,634,873 A * 6/1997 Carlstrom ..... 482/95
5,720,702 A * 2/1998 Lee ..... 482/129
5,824,966 A * 10/1998 Leight ..... 181/130
6,013,014 A * 1/2000 Hern ..... 482/121
6,059,698 A * 5/2000 Mazor ..... 482/79
7,223,219 B2 * 5/2007 Liester ..... 482/126
2007/0149369 A1 * 6/2007 Finch ..... 482/140

* cited by examiner

*Primary Examiner* — Jerome w Donnelly
(74) *Attorney, Agent, or Firm* — Charles J. Prescott, P.A.

(57) ABSTRACT

A portable punching bag apparatus including a support plate sized in width to fit, when horizontally oriented, within a doorway. A punching bag is supported from a central area of the lower surface of the support plate. A doorway contact bar is also connected to the support plate and extends beyond the side margins and the sides of the doorway. A door molding engaging bar is connected to the support plate parallel to the contact bar and positioned above the support plate such that the apparatus is supported on the top molding when the engaging bar is resting atop an upper edge of the top molding. A clamp support connected to the support plate supports an elongated clamp rod for tightening a distal end thereof against the wall above a top of the doorway whereby the apparatus is removably securable for use beneath the top of the doorway.

3 Claims, 7 Drawing Sheets

PORTABLE PUNCHING BAG APPARATUS

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to exercise equipment, and more particularly to a portable punching bag apparatus which is easily transportable and attachable to any conventional doorway framework having door moldings.

2. Description of Related Art

The field of exercise and body conditioning equipment continues to grow as an industry, providing the end user with an ever broadening variety of exercise equipment which may be used in a home setting or have portability which facilitates convenient transport of such exercise equipment. Additionally, exercise equipment has become more user-friendly in that very little space for ancillary support structure or attachment thereto is required for convenience of use.

The use of a punching bag has also gained in popularity in that the repetitive arm and hand motion not only generates quickness of timing and muscle strengthening and eye-hand coordination, but also expends great amounts of energy for body weight control. However, known punching bag apparatus are quite complex, requiring either a ceiling mount for the punching bag permanently attached to an overhead structure or an extensive floor mounted structure with sufficient strength and mass to deal with the repetitive impact of punching bag strikes.

The present invention provides a portable punching bag apparatus which is easily attachable within any doorway having conventional moldings therearound. The apparatus may be left in place for use for an extended period of time, or may be easily removed during periods of non-use and disassembled by simply removing the punching bag and carrying the remaining mounting structure of the apparatus in a carrying bag or by other convenient transfer means.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a portable punching bag apparatus including a support plate sized in width to fit within a doorway. A punching bag is supported centrally of a lower surface of the support plate while a doorway contact bar is connected to support plate, each end of the contact bar extending beyond the side margins of the support plate, the length of the contact bar being greater than the width of the doorway. A door molding engaging bar is also connected to the support plate parallel to the contact bar and positioned above the support plate a distance sufficient to rest atop a top molding of the doorway whereby the apparatus is supported by the engaging bar against an upper edge of the top molding. A clamp support is connected to and extends above the support plate. An elongated clamp rod is selectively movably held by the clamp support for tightening against a wall surface above a top of the doorway on an opposite side of the wall from the engaging bar whereby the apparatus is removably securable for use beneath the top of the doorway.

It is therefore an object of this invention to provide a portable punching bag apparatus which is easily attachable to the top of a doorway.

It is another object of this invention to provide an easily attachable punching bag apparatus which has adjustability for both doorway width and wall thickness.

Still another object of this invention is to provide a punching bag apparatus which, after being attached to the top of a doorway frame for use, may be easily removed and stored.

Another object of this invention is to provide an economical punching bag apparatus which will easily attach to a doorway framework without the necessity for either tools or fasteners of any sort.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
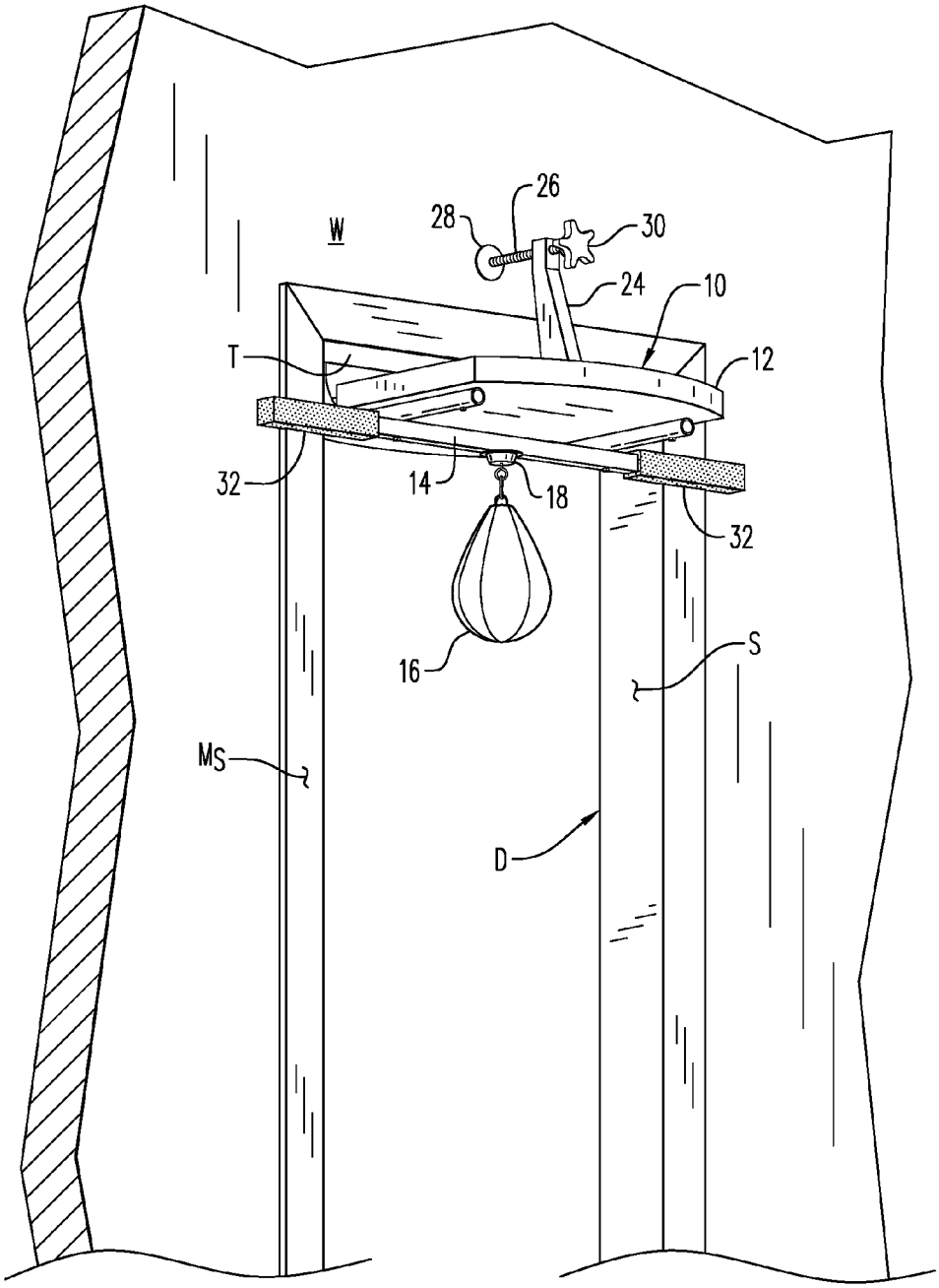
FIG. 1 is a perspective of the apparatus in place ready for use within a doorway.

Exemplary embodiments are illustrated in reference figures of the drawings. It is intended that the embodiments and figures disclosed herein are to be considered to be illustrative rather than limiting.

DETAILED DESCRIPTION OF THE INVENTION

Nomenclature

10. punching bag apparatus
12. support plate
14. doorway contact bar
16. punching bag
18. bag support
20. doorway molding engaging bar support
22. doorway molding engaging bar
24. clamp support

Figure 2:
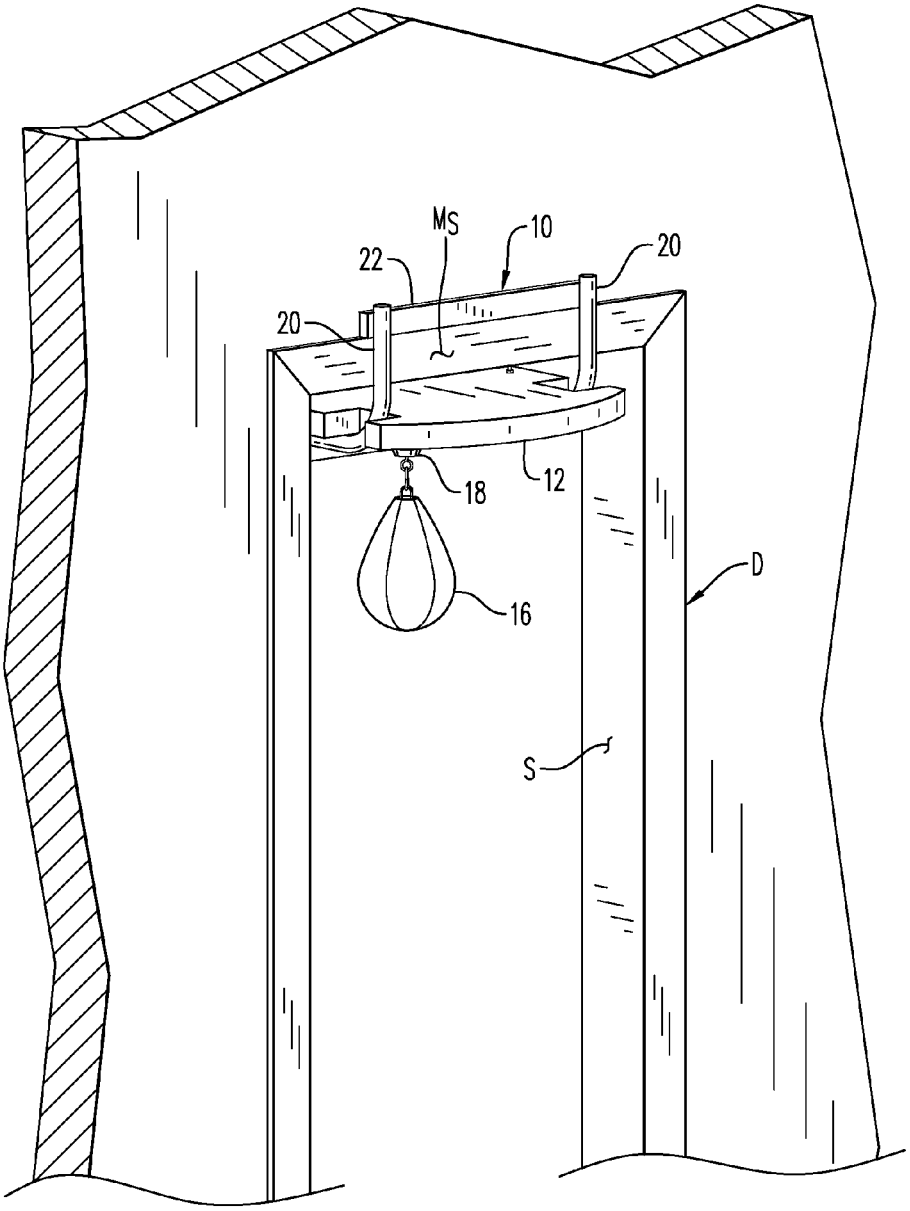
FIG. 2 is another perspective view of the apparatus of FIG. 1.

24'. clamp support
26. clamp rod
26'. clamp rod
28. wall engaging disc
30. clamp tightening handle
30'. clamp tightening handle
32. cover Referring now to the drawings, one embodiment of the invention is shown generally at numeral 10 in the in-use position within a doorway D in FIGS. 1 and 2. As better seen in FIGS. 3 to 8, the apparatus 10 includes a flat support plate 12 formed of laminated wood, molded plastic material or other suitable material and having a width somewhat narrower than the width of a conventional doorway D. In the in-use position, the apparatus 10 is positioned just below the top T of the doorway D so that the punching bag 16 held on a bag support 18 will be positioned at about user eye level.

As best seen in FIGS. 3 to 8, an elongated doorway contact bar 14 is securely attached to, and extends across the width of the support plate 12 beneath the mid-portion of the bottom surface of the support plate 12. The overall length of the contact bar 14 is substantially greater than the width of the doorway D so that non-marring covers 32 over the distal portion of each end of the contact bar 14 will be positioned against the side moldings $M_s$ of the doorway D.

Figure 5:
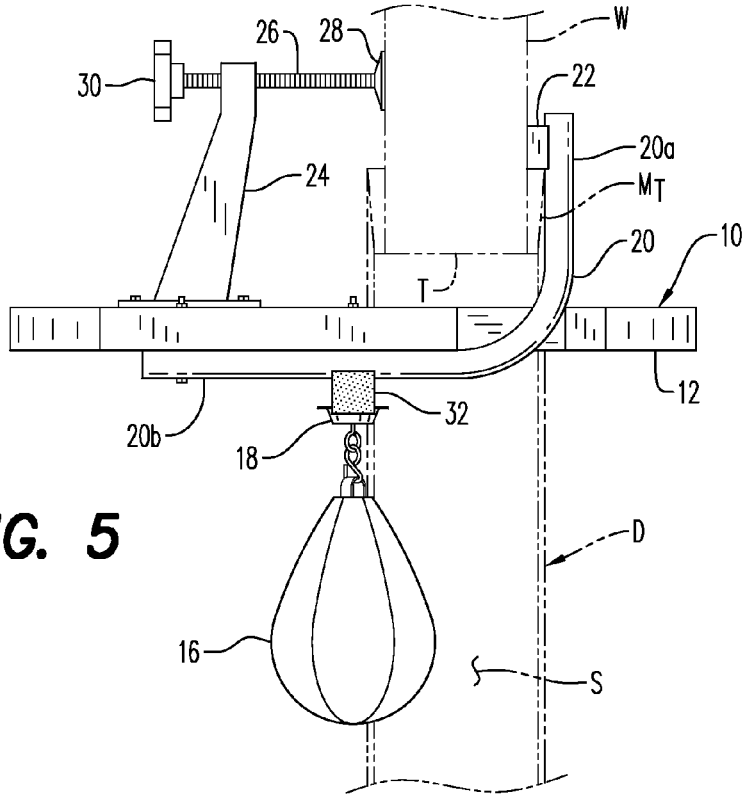
FIG. 5 is a side elevation view of the apparatus showing the doorway and doorway moldings in phantom.
Figure 6:
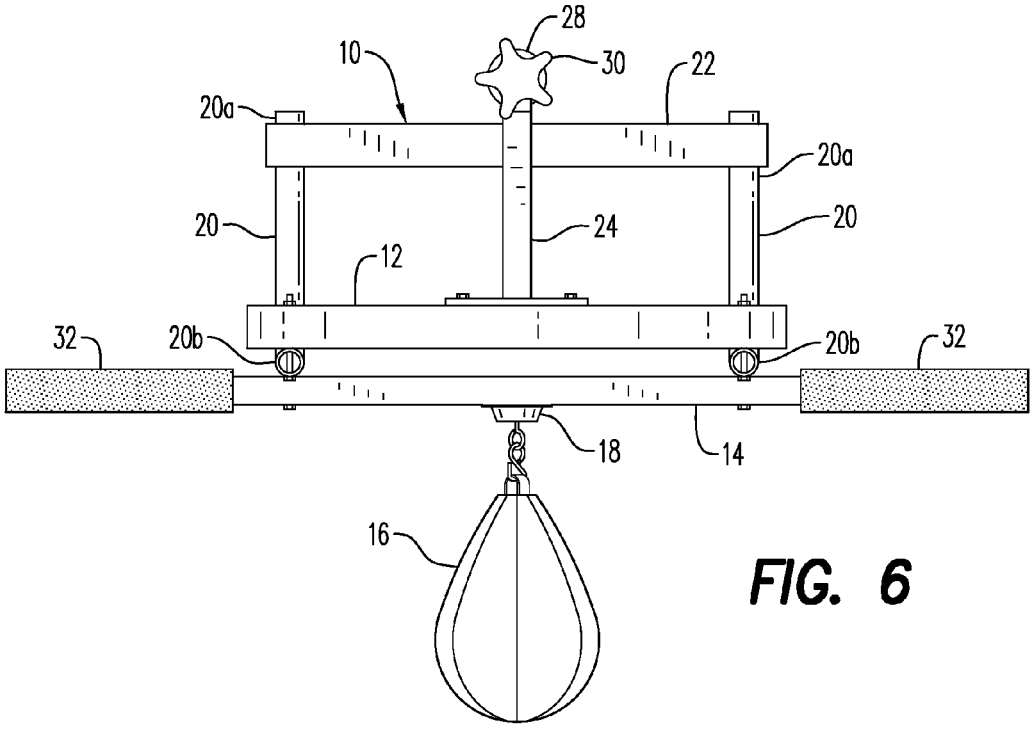
FIG. 6 is a left end elevation view of FIG. 5.
Figure 7:
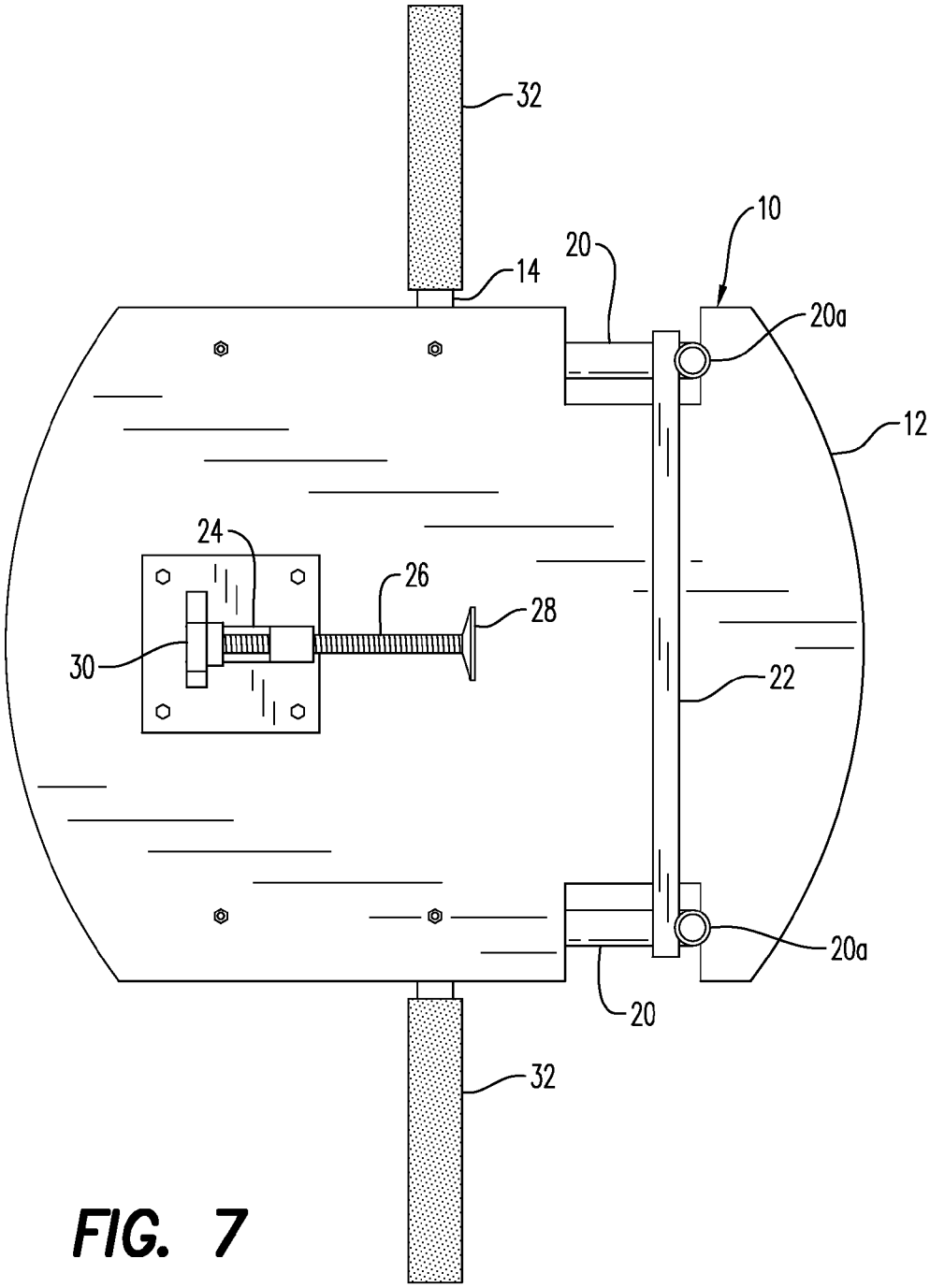
FIG. 7 is top plan view of FIG. 5.
Figure 8:
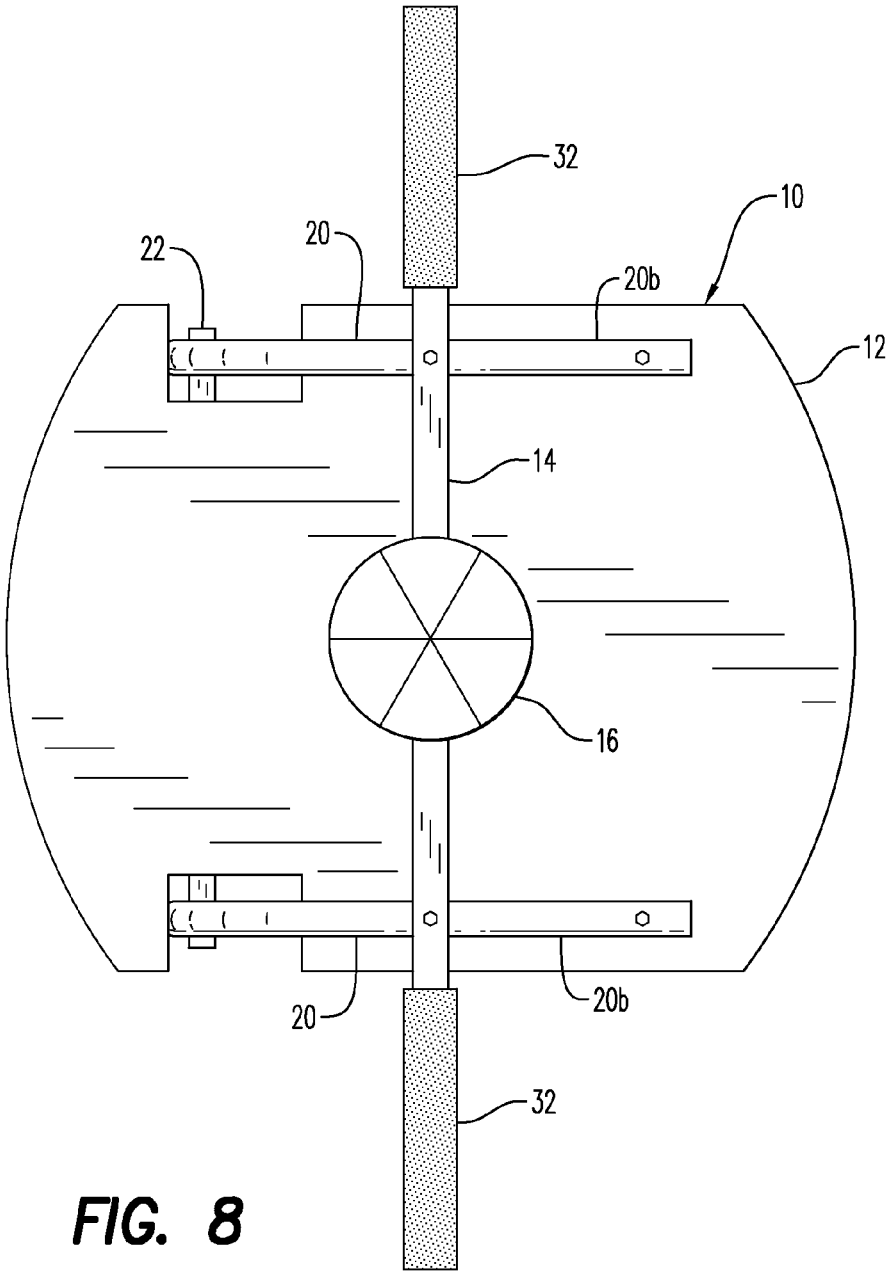
FIG. 8 is a bottom plan view of FIG. 5.

Two spaced apart doorway molding engaging bar supports 20, each having an elongated horizontal leg 20*b* and an upright leg 20*a*, are fastened by mechanical fasteners along each side edge of the support plate 12. The upright leg 20*a* is positioned through notches cut into the side margins of the support plate 12 as shown. Extending between and attached to the upper distal ends of the upright support legs 20*a* is an elongated door molding engaging bar 22. This engaging bar 22 is positioned transversely to the length of the support plate 12 and spaced thereabove a distance, as best seen in FIG. 5, so as to be engageable against the upper margin of a top doorway molding $M_t$ which is permanently attached to the doorway along the top T of the doorway D. The punching bag 16 is connected to a bag support 18 which, in turn, is rigidly or permanently connected to, and hangs downwardly from, the contact bar 14.

Figure 3:
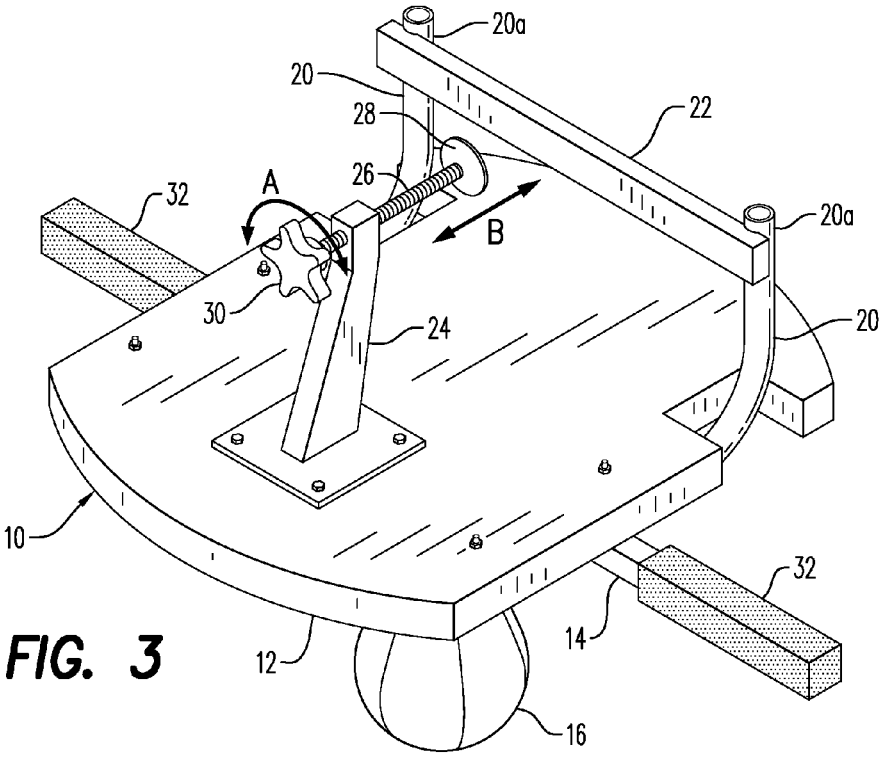
FIG. 3 is a perspective of the apparatus.
Figure 4:
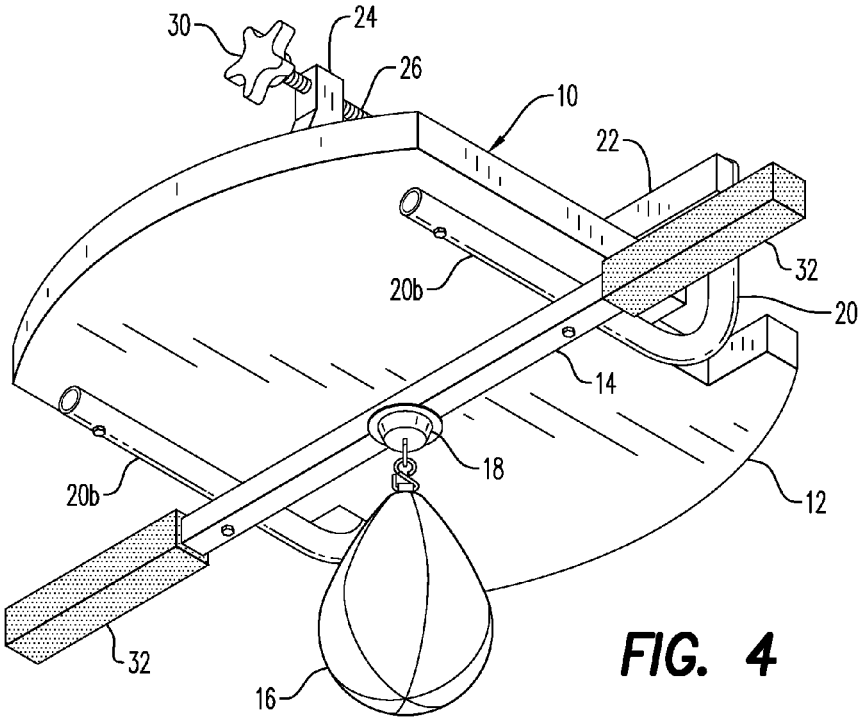
FIG. 4 is another perspective view of the apparatus.

A clamp arrangement includes a clamp support 24 which is connected along the longitudinal center line of the upper surface of the support plate 12 as best seen in FIGS. 3 and 5. This clamp support 24 includes a threaded aperture having an axis aligned above and parallel to the support plate 12. This threaded aperture supports an elongated threaded clamp rod 26 which is rotatably movable axially by a clamp tightening handle 30 by rotation back and forth in the direction of arrow A, causing a corresponding longitudinal movement in the direction of arrow B of a wall engaging disc 28 attached to the distal end of the threaded clamp rod 26.

As best seen in FIGS. 1, 2 and 5, the apparatus 10 is positionable within the doorway D and the between doorway sides S beneath the top T of the doorway with the support plate 12 positioned just below the lower surface of the top T such that the door molding engaging bar 22 rests atop the upper margin of the top molding $M_t$ attached on one side of the wall W. Thereafter, the tightening handle 30 is rotated so as to move the wall engaging disc 28 so as to make contact with the opposite side of the wall W above the opposite top molding $M_t$. As tightening of the handle 30 continues, the apparatus 10 is manually leveled and, when the tightening process is complete, the apparatus 10 is held securely within the position shown with the punching bag 16 at an eye-level orientation ready for use.

It is noted that no fasteners or tools are required of any sort to engage and remove the apparatus 10 to and from its in-use deployed orientation shown in the figures. No mechanical fasteners are required and, because the contact surfaces that the apparatus make with the doorway and adjacent wall and moldings are protected, virtually no marring or damage to any of the existing doorway structure results from installation and use of the apparatus 10.

Figure 9:
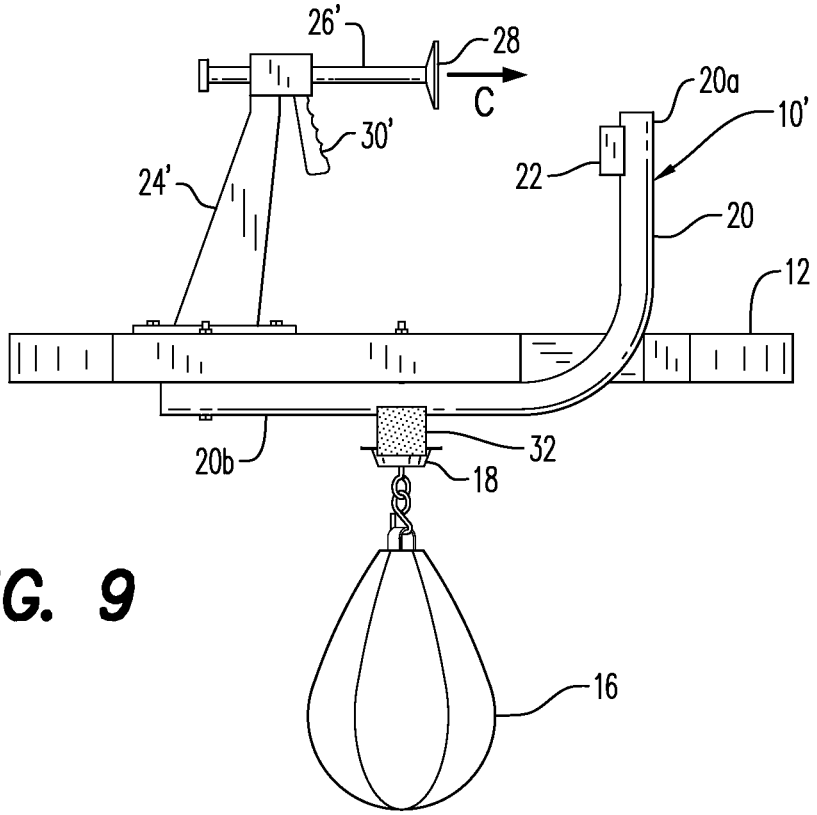
FIG. 9 is a side elevation view of an alternate and preferred embodiment of the invention.

Referring now to FIG. 9, an alternate and preferred embodiment of the clamp arrangement is there shown. The clamp support 24' is attached by mechanical fasteners to the top surface of the support plate 12. Securely disposed at the upper distal end of the clamp support 24' is a squeezable tightening handle 30' which, when hand-squeezed together, extends the clamp rod 26' in the direction of arrow C. This arrangement, similar to that of a caulking gun, will effect more expedited installation and removal and is the preferred embodiment for this apparatus 10'.

While a number of exemplary aspects and embodiments have been discussed above, those of skill in the art will recognize certain modifications, permutations and additions and subcombinations thereof. It is therefore intended that the following appended claims and claims hereinafter introduced are interpreted to include all such modifications, permutations, additions and subcombinations that are within their true spirit and scope.

The invention claimed is:

1. A portable punching bag apparatus comprising:

a support plate having an upper and a lower surface and being sized in width between side margins thereof to fit within the sides of a doorway;

a punching bag supported on, and hanging downwardly from, a central area of said lower surface of said support plate;

a doorway contact bar connected to said support plate, each end of said contact bar extending beyond one said side margin a distance greater than a width of the doorway;

a doorway top molding engaging bar connected to said support plate and oriented parallel to said contact bar and being positioned above and parallel to said upper surface at a height at least equal to a width of a top molding of the doorway whereby said apparatus is supportable on the top molding when said engaging bar is positioned against an upper edge of the top molding;

a clamp support connected to and extending above the upper surface of said support plate;

an elongated clamp rod selectively movably held by said clamp support for tightening a distal end of said clamp rod against a wall surface above a top of the doorway on an opposite side of the wall from said engaging bar;

whereby said apparatus is removably securable for use within and beneath the top of the doorway.

2. A portable punching bag apparatus comprising:

a support plate having an upper and a lower surface and being sized in width between side margins of said support plate to fit in a horizontal orientation within a doorway;

a punching bag connectable to a central area of said lower surface of said support plate;

a doorway contact bar connected to said support plate, each end of said contact bar having a length substantially greater than a width of a doorway and extending beyond each said side margin;

two spaced apart doorway molding engaging bar supports each having a horizontal leg connected to one said side margin, each said bar support also having an upright leg which extends upwardly through a notch formed into each said side margin;

a doorway molding engaging bar connected to and extending horizontally between a distal end of each of said upright legs, said engaging bar being positioned above and parallel to said upper surface a distance at least equal to a width of a top molding of the doorway whereby said apparatus is supportable on the top molding when said engaging bar is positioned against an upper edge of the top molding;

a clamp support connected to and extending above the upper surface of said support plate;

an elongated clamp rod selectively movably held by said clamp support to tighten a distal end of said clamp rod against a wall surface above a top of the doorway on an opposite side of the wall from said engaging bar;

whereby said apparatus is removably securable for use beneath the top of the doorway.

3. A portable punching bag apparatus comprising:

a support plate having an upper and a lower surface and being sized in width between side margins thereof to fit in a horizontal orientation between the sides of a doorway;

a punching bag connectable to a central area of said lower surface of said support plate;

a doorway contact bar connected to said support plate, each end of said contact bar extending beyond each said side margin a distance greater than a width of the doorway;

a clamp support connected to and extending above the upper surface of said support plate;

an elongated clamp rod having a wall engaging disc attached at a distal end thereof, said clamp rod being selectively movably held by said clamp support to tighten said wall engaging disc against a wall surface above a top of the doorway on an opposite side of the wall from said engaging bar;

a door molding engaging bar connected to said support plate parallel to said contact bar and positioned above and parallel to said upper surface a distance at least equal to a width of a top molding of the doorway;

whereby said apparatus is removably securable for use beneath the top of the doorway when said engaging bar is positioned against an upper edge of the top molding and said clamp rod is activated to tighten said wall engaging disc against the wall opposite from said engaging bar.

* * * * *